US009957787B2

(12) United States Patent
Dallas

(10) Patent No.: US 9,957,787 B2
(45) Date of Patent: May 1, 2018

(54) METHOD OF ENHANCED OIL RECOVERY FROM LATERAL WELLBORES

(71) Applicant: Lloyd Murray Dallas, Streetman, TX (US)

(72) Inventor: Lloyd Murray Dallas, Streetman, TX (US)

( * ) Notice: Subject to any disclaimer, the term of this patent is extended or adjusted under 35 U.S.C. 154(b) by 230 days.

(21) Appl. No.: 14/887,693

(22) Filed: Oct. 20, 2015

(65) Prior Publication Data

US 2017/0107805 A1 Apr. 20, 2017

(51) Int. Cl.

| | |
|---|---|
| ***E21B 43/16*** | (2006.01) |
| ***E21B 7/06*** | (2006.01) |
| ***E21B 33/12*** | (2006.01) |
| ***E21B 43/11*** | (2006.01) |
| ***E21B 33/14*** | (2006.01) |
| ***E21B 43/30*** | (2006.01) |

(52) U.S. Cl.

CPC ..... *E21B 43/16* (2013.01); *E21B 7/06* (2013.01); *E21B 33/12* (2013.01); *E21B 33/14* (2013.01); *E21B 43/11* (2013.01); *E21B 43/305* (2013.01)

(58) Field of Classification Search

CPC .... E21B 43/16; E21B 43/305; E21B 41/0035; E21B 43/2406; E21B 43/30; E21B 7/046; E21B 7/06; E21B 33/12; E21B 33/13; E21B 33/14

See application file for complete search history.

(56) References Cited

U.S. PATENT DOCUMENTS

| | | | | |
|---|---|---|---|---|
| 5,626,193 | A | 5/1997 | Nzekwu et al. | |
| 5,988,278 | A | 11/1999 | Johnson | |
| 6,662,870 | B1 | 12/2003 | Zupanick et al. | |
| 6,729,394 | B1 | 5/2004 | Hassan et al. | |
| 7,059,402 | B2 | 6/2006 | Lima et al. | |
| 7,104,320 | B2 | 9/2006 | Buchanan et al. | |
| 7,464,756 | B2 * | 12/2008 | Gates | C09K 8/592 166/263 |
| 7,513,304 | B2 | 4/2009 | Stayton | |
| 8,220,547 | B2 | 7/2012 | Craig et al. | |
| 8,528,639 | B2 | 9/2013 | Fang et al. | |
| 8,646,526 | B2 | 2/2014 | Suarez-Rivera et al. | |
| 2005/0178542 | A1 | 8/2005 | Lima et al. | |
| 2006/0207765 | A1 * | 9/2006 | Hofman | E21B 21/103 166/313 |
| 2007/0158073 | A1 * | 7/2007 | Green | E21B 41/0035 166/313 |
| 2009/0255661 | A1 * | 10/2009 | Clark | E21B 41/0035 166/50 |
| 2010/0163250 | A1 * | 7/2010 | Schultz | E21B 17/07 166/381 |
| 2011/0024121 | A1 * | 2/2011 | Skeates | E21B 41/0035 166/308.1 |

(Continued)

*Primary Examiner* — Carib A Oquendo
(74) *Attorney, Agent, or Firm* — Bennett Mullinax, LLC

(57) ABSTRACT

Enhanced oil recovery is practiced in long lateral wellbores by drilling at least one of a sidetrack lateral wellbore end a branch lateral wellbore from the main lateral wellbore. After production of the sidetrack lateral wellbore or the branch lateral wellbore, EOR flood fluid is pumped info the at least one of the sidetrack lateral wellbore and the branch lateral wellbore and recovered hydrocarbons and EOR flood fluid are produced from the main lateral wellbore, or vice versa.

9 Claims, 12 Drawing Sheets

(56) References Cited

U.S. PATENT DOCUMENTS

| | | | | |
|---|---|---|---|---|
| 2012/0199349 | A1* | 8/2012 | Themig | E21B 34/14 166/285 |
| 2013/0081807 | A1* | 4/2013 | Dyer | E03B 3/14 166/254.2 |
| 2013/0228337 | A1 | 9/2013 | Dombrowski et al. | |
| 2013/0327572 | A1* | 12/2013 | Sponchia | E21B 41/0035 175/61 |
| 2014/0262240 | A1 | 9/2014 | Boone et al. | |
| 2015/0007988 | A1 | 1/2015 | Ayasse | |
| 2015/0007996 | A1 | 1/2015 | Ayasse | |

* cited by examiner

METHOD OF ENHANCED OIL RECOVERY FROM LATERAL WELLBORES

FIELD OF THE INVENTION

This invention relates in general to hydrocarbon production and, in particular, to a novel method of enhanced oil recovery from lateral wellbores.

BACKGROUND OF THE INVENTION

Enhanced oil recovery (EOR) is a process of obtaining stranded oil not recoverable from a hydrocarbon production zone using standard extraction processes. EOR is practiced by injecting EOR "flood fluid" under pressure and recovering mobilized oil mixed with the flood fluid. Various flood fluids ere used, including hot water or steam; gases (e.g., nitrogen, carbon dioxide, natural gas, liquid natural gas or propane), solvents (e.g. diesel fuel or other carbonaceous solvents) chemical solutions (e.g., alkaline compounds, polymers and/or surfactants), and low-salinity water.

EOR was first practiced in heavy oil deposits by injecting steam into a wellbore for a long period of time and then recovering mobilized heavy oil from the wellbore. EOR is now widely practiced using one or more injection bores in conjunction with one or more adjacent recovery wells where stranded oil and/or gas are produced to the surface. More recently, EOR has been practiced in a single lateral wellbore in deep tight oil reservoirs. A first pipe is used to inject flood fluid into fractured injection zones and a second pipe in the same wellbore is used to produce stranded oil from fractured production zones interleaved with the injection zones. Packers isolate the injection zones from the interleaved production zones of the wellbore.

While the traditional EOR practices are effective for stranded oil recovery, they are most economical for shallow production zones and relatively short lateral bores When a production zone is deep (i.e., 10,000 feet or more), drilling multiple bores for EOR can become uneconomical. Likewise, when surface access to the reservoir is limited (i.e. near cities, suburban areas, farm land, or wetland) drilling multiple spaced-apart bores within a large area may not be an option. Recent developments in EOR methods for deep, tight oil appear to be suitable for use only in relatively short lateral bores.

There therefore exists a need for a novel method of enhanced oil recovery from lateral wellbores.

SUMMARY OF THE INVENTION

It is therefore an object of the invention to provide a novel method of enhanced oil recovery from lateral wellbores.

The invention therefore provides a method of enhanced oil recovery (EOR) from a cased and cemented main lateral wellbore, comprising: setting a packer in the main lateral wellbore; drilling at least one sidetrack lateral wellbore spaced from the main lateral wellbore, casing and cementing the sidetrack lateral wellbore; producing hydrocarbons from the sidetrack lateral wellbore; removing the packer from the main lateral wellbore; running production tubing and a packer into the main lateral wellbore and setting the packer in the main lateral wellbore; injecting EOR flood fluid down an annulus of a vertical section of the main lateral wellbore and into the sidetrack lateral wellbore; and producing hydrocarbons comingled with EOR flood fluid up the production tubing in the main lateral wellbore while injecting the EOR flood fluid.

The invention further provides a method of enhanced oil recovery (EOR) from a cased and cemented main lateral wellbore, comprising: perforating, stimulating and flowing back a first section of the main lateral wellbore, the first section having a length less than a total length of the main lateral wellbore, and producing hydrocarbons from the first section of the main lateral wellbore; drilling at least one branch lateral wellbore in an unperforated region of the main lateral wellbore adjacent the perforations of the first section of the main lateral wellbore; casing and cementing the at least one branch lateral wellbore; perforating, stimulating and flowing back the at least one branch lateral wellbore and producing hydrocarbons from the at least one branch lateral wellbore; running production tubing and a packer into the main lateral wellbore and setting the packer to isolate the main lateral wellbore from the at least one branch lateral wellbore; and injecting EOR flood fluid down an annulus of a vertical section of the main lateral wellbore, an imperforated section of the main lateral wellbore and into the at least one branch lateral wellbore, and producing hydrocarbons comingled with EOR flood fluid up the production tubing.

The invention yet further provides a method of enhanced oil recovery (EOR) from a cased and cemented main lateral wellbore that has been produced until production from the main lateral wellbore becomes uneconomic, comprising: drilling at least one branch lateral wellbore from an end of the main lateral wellbore, casing and cementing the at least one branch lateral wellbore; perforating, stimulating and flowing back the at least one branch lateral wellbore and producing hydrocarbons from the at least one branch lateral wellbore; running production tubing and a packer into the main lateral wellbore and setting the packer in one of the at least one branch lateral wellbores; and, injecting EOR flood fluid down the production tubing and producing hydrocarbons comingled with the EOR flood fluid from an annulus of the main lateral wellbore.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a method of enhanced oil recovery from lateral wellbores that enables the recovery of more stranded oil from long lateral wellbores. However, the methods in accordance with the invention are equally applicable to new or existing shorter lateral wellbores, in accordance with the invention, sidetrack end/or branch lateral wellbores are drilled for the purpose of enhanced oil recovery (EOR). In one embodiment, hydrocarbons are produced from the sidetrack and/or branch lateral wellbores before EOR is commenced. The sidetrack lateral wellbores are drilled from the vertical section or the curved section of the main wellbore. The branch lateral wellbores are drilled from the horizontal section of the main lateral wellbore. In one embodiment, the sidetrack and branch lateral wellbores are drilled substantially parallel to the main lateral wellbore. A distance between a sidetrack/branch lateral wellbore and the main lateral wellbore is dependent on a porosity, commonly referred to as a "tightness", of the production zone, physical geometry of the production zone, lease rights, proximity of adjacent wellbores, etc.

Figure 1:
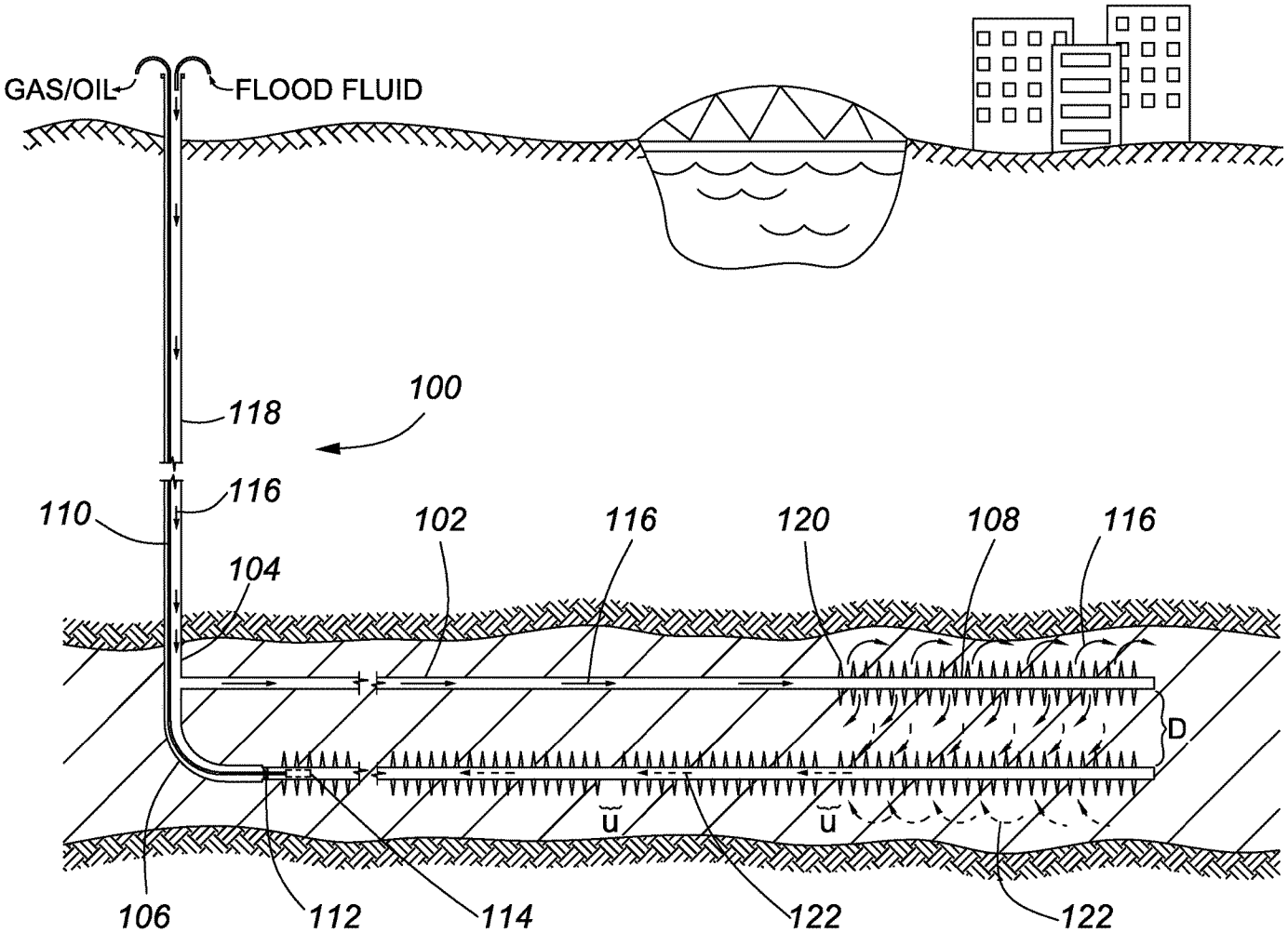
FIG. 1 is a schematic cross-sectional diagram of a first method of enhanced oil recovery from a long lateral wellbore in accordance with the invention.

FIG. 1 is a schematic cross-sectional diagram of a first method of enhanced oil recovery from a long lateral wellbore 100 in accordance with the invention. After the long lateral wellbore 100 has been drilled and produced in sections separated by unperforated areas "u", in accordance with methods described in applicant's co-pending U.S. patent application Ser. No. 14/827,722 filed on Aug. 17, 2015, the specification of which is incorporated herein by reference, at least one sidetrack lateral 102 is drilled from the vertical section 104 of the lateral wellbore 100. As understood by those skilled in the art, the at least one sidetrack lateral 102 can optionally be drilled from the curved section 106 of the lateral wellbore 100. In accordance with one embodiment of the invention, the sidetrack lateral 102 is drilled substantially parallel with the main lateral wellbore 100, and is at least about as long as the main lateral wellbore 100, though shorter sidetrack laterals in conjunction with side branch laterals may also be used, as will be described below in more detail. A distance "D" is between the main lateral wellbore 100 and the sidetrack lateral wellbore 102 is determined by the well operator using known physical dimensions and characteristics of the production zone, including production zone porosity, production zone depth end extent lease restrictions and/or adjacent well proximity, etc. In general, the distance "D" is maximized within the physical and legal constraints of any particular wellbore in any particular production zone.

As shown in FIG. 1 the sidetrack lateral 102 is not drilled until the main lateral wellbore 100 has been produced and production from the main lateral wellbore 100 is complete or substantially complete. As further shown in FIG. 1, in accordance with one embodiment of the invention, the sidetrack lateral wellbore(s) 102 is cased and cemented and then produced, just as the main lateral wellbore 100 was produced, in one embodiment, the sidetrack lateral wellbore(s) 102 is perforated, stimulated, flowed back and produced in sections separated by unperforated regions "u". In that case, a first section 108 is perforated and stimulated using known methods and hydrocarbon is produced from that section until production from that section is complete or substantially complete. Thereafter, if production tubing 110 was used for production in the sidetrack lateral 102 it is pulled from the sidetrack lateral 102. Production tubing 110 is then run into the main lateral wellbore 100. A packer 112 is set to isolate the main lateral wellbore 100 from the sidetrack lateral(s) 102 and to seal around the production tubing 110. EOR flood fluid 116 is pumped down the vertical section 104 and into the sidetrack lateral wellbore(s) 102 and is forced through perforations 120 in the sidetrack lateral wellbore(s) 102 and displaces stranded oil 122 which follows the path of least resistance into the main lateral wellbore 100 where the stranded oil 122 comingled with flood fluid 116 are conducted to the surface through the production tubing 110. A downhole pump 114 is used to produce the stranded oil 122 form the main lateral wellbore if the EOR flood fluid 116 pumped down the annulus 118 of the lateral wellbore 100 and into the sidetrack lateral 102 does not lift the stranded oil 122 to the surface. EOR injection is continued until oil production is no longer economical. Thereafter, the production tubing 110, packer 112 and pump 114 are pulled from the main lateral wellbore 100, and a packer (not shown) is run into the sidetrack lateral 102 to isolate the first section 108 from the remainder of the sidetrack lateral 102. A next section of the sidetrack lateral 102 is then perforated, stimulated and produced and the EOR process described above is repeated until the entire sidetrack lateral(s) 102 has been produced and the EOR from the lateral wellbore 100 is completed.

Figure 2:
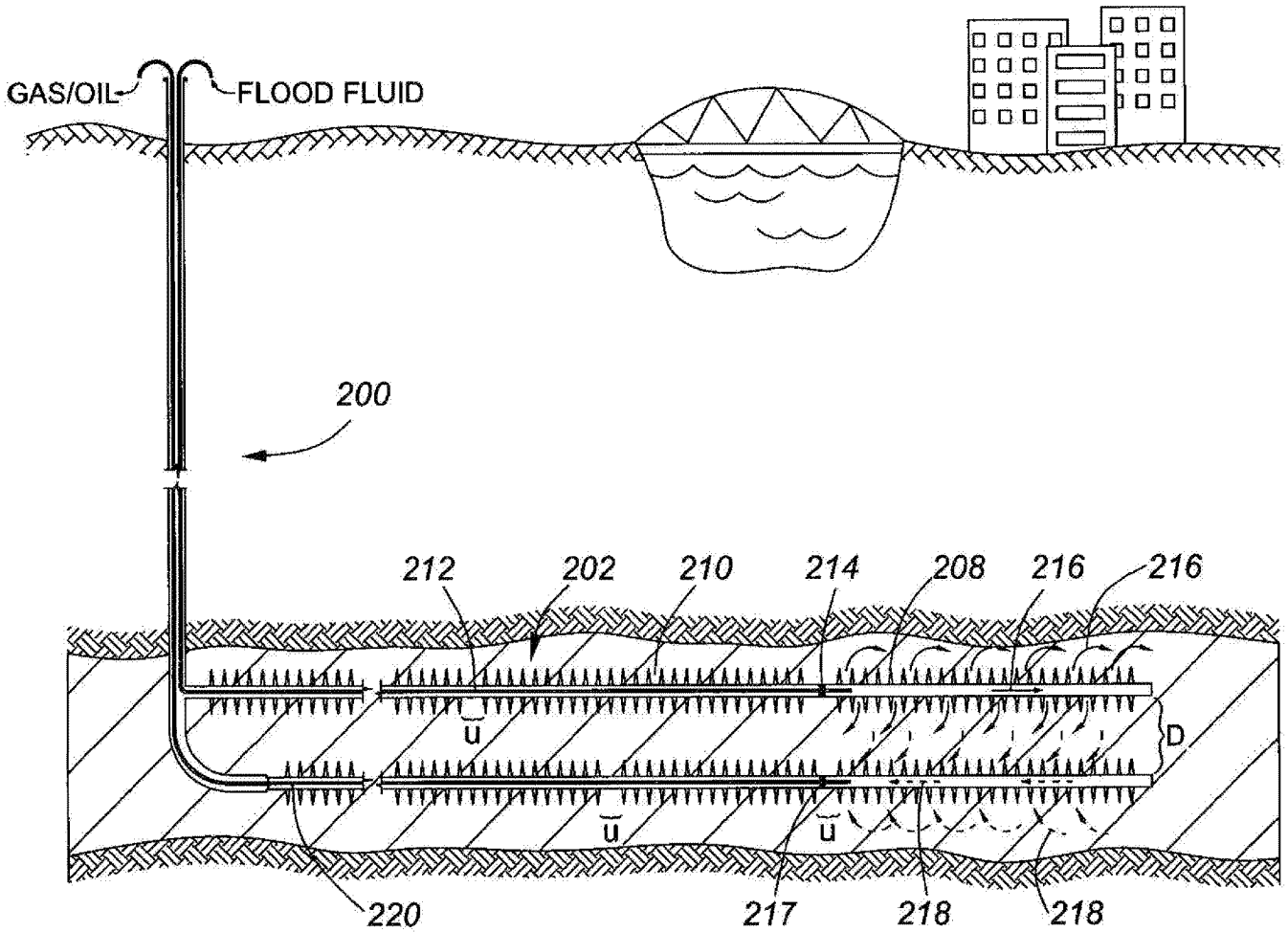
FIG. 2 is a schematic cross-sectional diagram of a further method of enhanced oil recovery from a long lateral wellbore in accordance with the invention.

FIG. 2 is a schematic cross-sectional diagram of a further method of enhanced oil recovery from a long lateral wellbore in accordance with the invention. In this embodiment, sidetrack lateral(s) 202 is cased and cemented and then produced in sections separated by unperforated intervals "u", just as the main lateral wellbore 100 was produced. Consequently, a first section 208 is perforated and stimulated using known methods and hydrocarbon is produced from the section 208. Thereafter, a next section 210 is perforated and stimulated and hydrocarbon is produced from section 210. This process is repeated until an entire length of the sidetrack lateral 202 has been produced. Thereafter, tubing 212 is run into the sidetrack lateral 202 and a packer 214 is set in the unperforated interval "u" between production sections 208 and 210 to pressure isolate production section 208. In one embodiment, tubing 220 is also run into the main lateral bore 100 and packer 217 is set to produce recovered oil 218 to the surface, though this is optional and the EOR flood fluid injection pressure may be adequate to produce the oil 218 to the surface. EOR flood fluid 216 is pumped down the tubing 212 and into the production section 208. This provides a focused flood and helps ensure a clean sweep of the production zone. After enhanced oil recovery becomes uneconomical, the packer 214 is released and the tubing 212 is pulled from the well. A packer (not shown) is then set in the unperforated interval "u" between production zones 208 and 210, the tubing is run back into the sidetrack lateral bore 202 and the packer 214 is set in the unperforated interval "u" between production section 210 and a next production section of the sidetrack lateral 202. The EOR process is repeated for each production section of the sidetrack lateral 202 until the entire production zone around the main lateral bore has been subjected to enhanced oil recovery to mobilize stranded oil 218 that is recovered in the main lateral wellbore 100.

Figure 3:
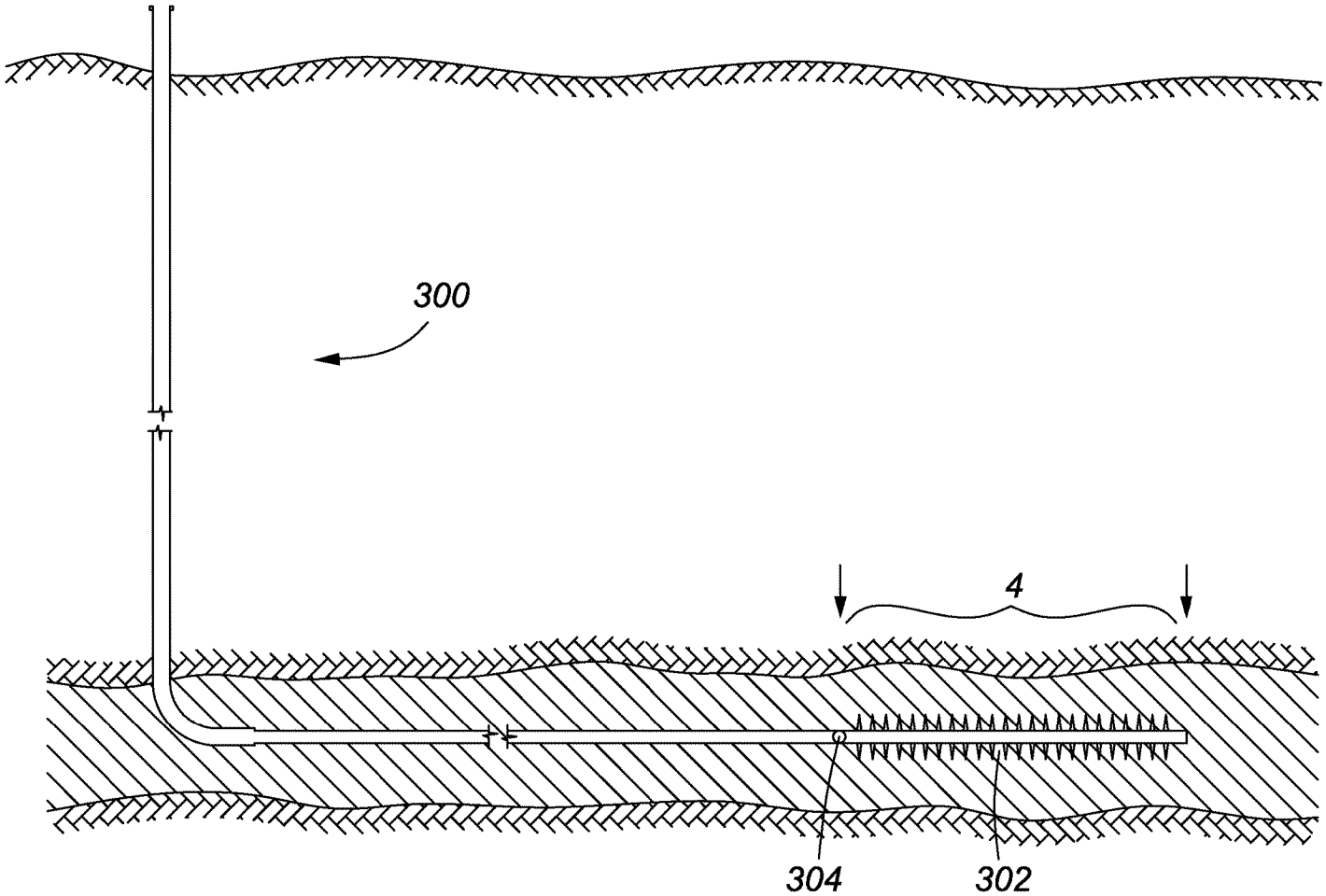
FIG. 3 is a schematic cross-sectional diagram of yet another method of enhanced oil recovery from a long lateral wellbore in accordance with the invention.

FIG. 3 is a schematic cross-sectional diagram of yet another method of enhanced oil recovery from a lateral wellbore 300 in accordance with the invention. In accordance with this embodiment, side branch lateral wellbores are used to perform a clean sweep of the lateral wellbore 300 from a "toe" of the lateral wellbore to a "heel" of the lateral wellbore 300. A first production section 302 of the lateral wellbore 300 is perforated, stimulated, flowed back and then produced until hydrocarbon production is complete or substantially complete. The first production section has a length 4 that is lees then a total length of the lateral wellbore 300. Re-stimulation of the production section 302 may be performed and a second production cycle undertaken at the well operator's discretion. Production tubing, if used, is then removed from the well and one or more "windows" (not shown) are cut in the casing of the long lateral wellbore near a beginning (heel side) of the perforations in the production section 302. A branch lateral wellbore 304 is then drilled through each window. The number of windows and branch lateral wellbores 304 is a matter of well operator choice and is dependent on the porosity of the production zone, available space in the production zone, lease constraints and other factors dependent on specific well conditions and related circumstances well understood in the art. In one embodiment the branch lateral wellbores 304 are drilled outwardly and curved to run substantially parallel with the main lateral wellbore 300. After the branch lateral wellbore(s) 304 are drilled, cased and cemented, they are perforated, stimulated and produced in sequence or in unison, as a matter of well operator's choice.

Figure 4:
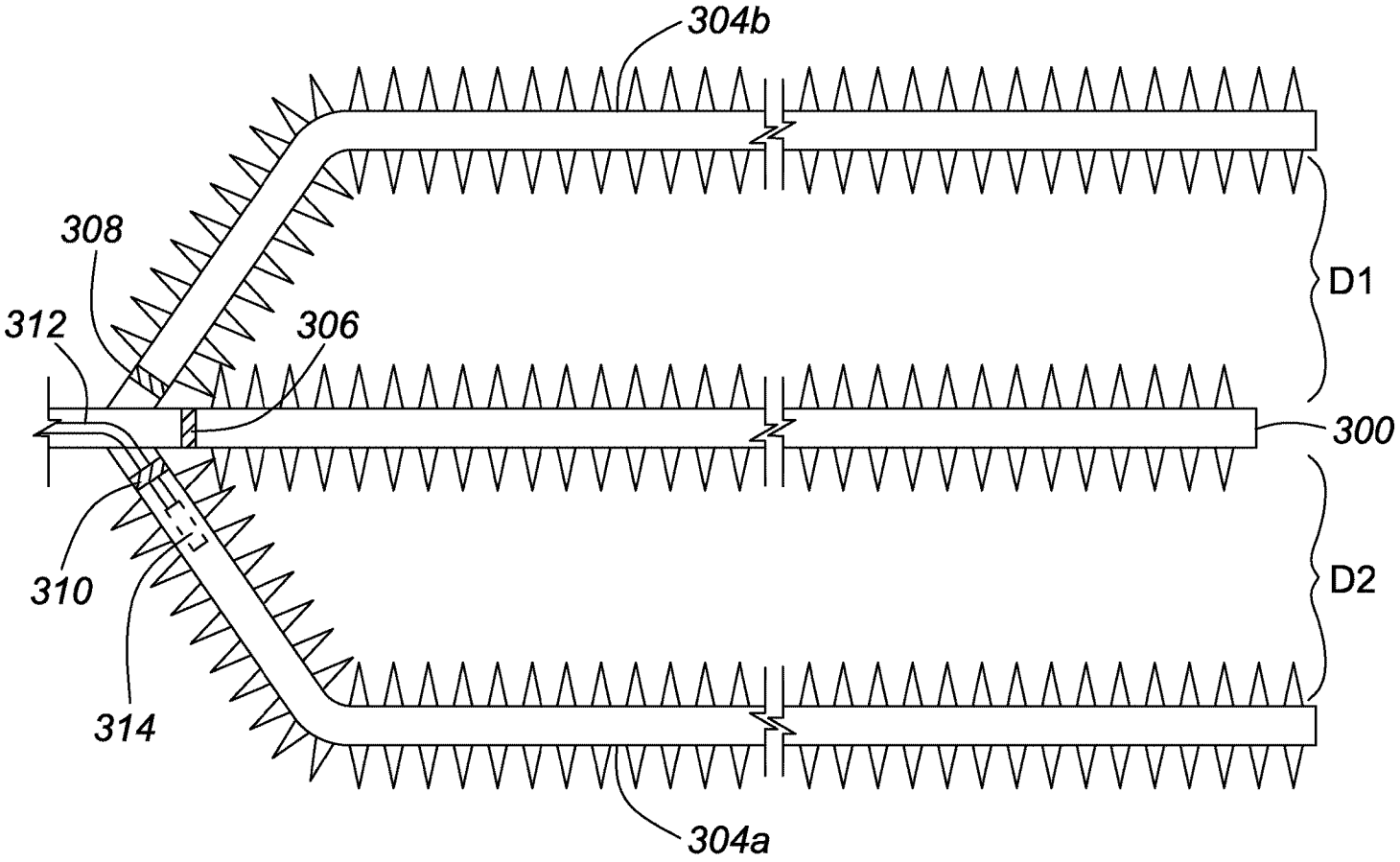
FIG. 4 is a schematic plan view of section 4-4 of the lateral hydrocarbon well shown in FIG. 3 showing branch lateral bores drilled from the main lateral bore, illustrating a first method of hydrocarbon production from the branch lateral bores.

FIG. 4 is a schematic plan view of section 4-4 of the lateral hydrocarbon well shown in FIG. 3, showing two branch lateral wellbores 304*a* and 304*b* drilled from the main lateral bore 300 to illustrate a first method or hydrocarbon production from the branch lateral wellbores 304*a* and 304*b*. In this embodiment, a packer 306 is set to isolate the produced section of the main lateral wellbore 300. Branch lateral wellbore 304*b* is perforated, stimulated, flowed back and plugged with a packer 308. Branch lateral wellbore 304*a* is then perforated, stimulated and produced if well pressure is adequate to lift hydrocarbons to surface. If well pressure is inadequate to lift the hydrocarbons to surface, or after well pressure drops below adequate lift pressure, a packer 310, production tubing 312 and optional downhole pump 314 are run into the wellbore 300 and the packer 310 is set in an imperforated region of the branch lateral wellbore 304*a*. Production is continued via the production tubing 312 using lift assistance until hydrocarbon production is complete or substantially complete. This procedure is then repeated for branch lateral wellbore 304*b*.

Figure 5:
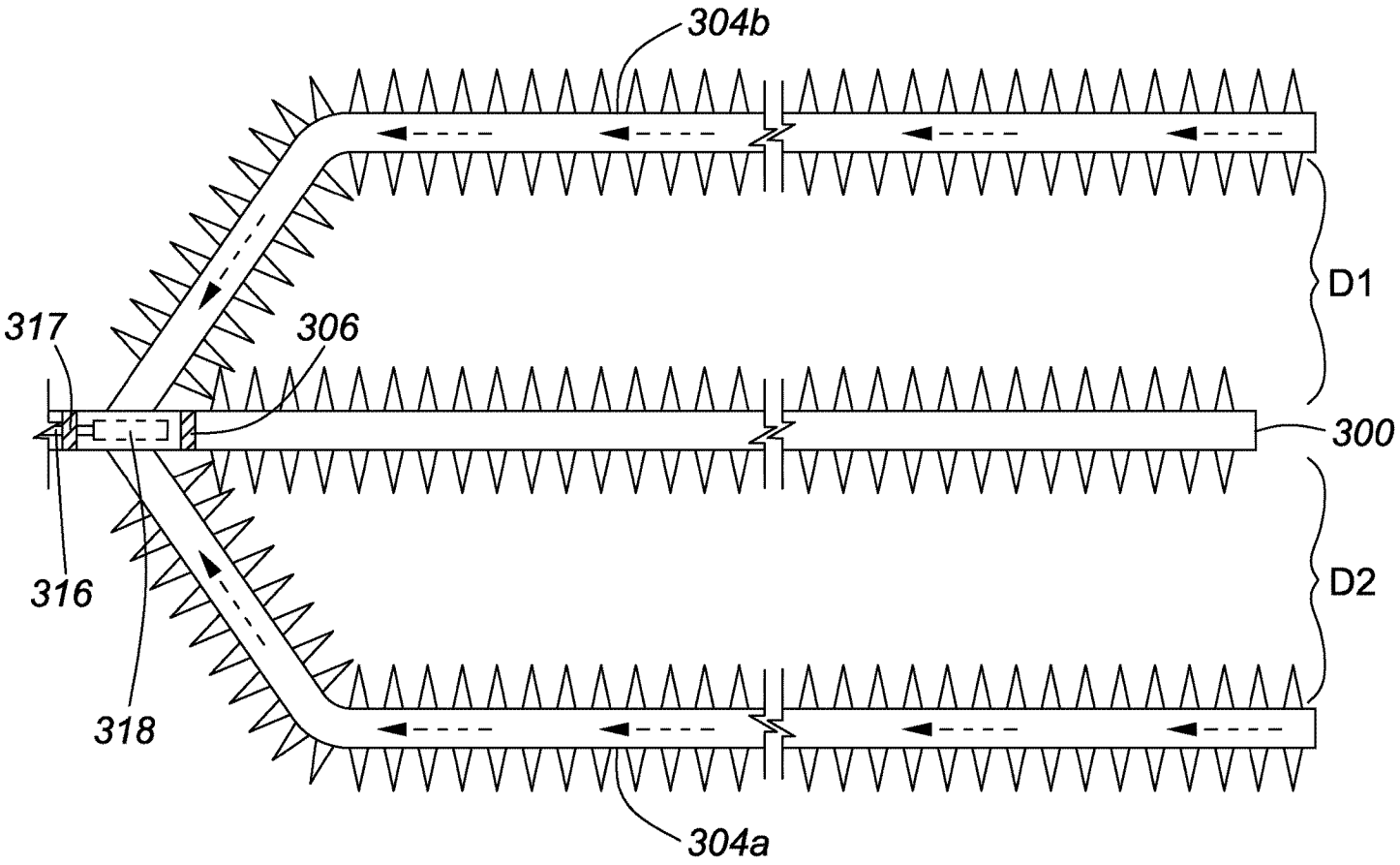
FIG. 5 is a schematic plan view of section 4-4 of the lateral hydrocarbon well shown in FIG. 3 illustrating another method or hydrocarbon production from the branch lateral bores.

FIG. 5 is a schematic plan view of section 4-4 of the lateral hydrocarbon well shown in FIG. 3 showing branch lateral bores 304*a*, 304*b* drilled from the main lateral bore and illustrating another method of hydrocarbon production from the branch lateral bores 304*a*, 304*b*. In this embodiment, the branch lateral wellbores 304*a*, 304*b* are respectively drilled, cased and cemented after the packer 306 has been set. One of the branch laterals 304*a*, 304*b* is then perforated, stimulated, flowed back and sealed off with a packer (not shown) until the other of the branch laterals 304*a*, 304*b* can be perforated, stimulated and flowed back. The packer is then removed and the branch laterals 304*a*, 304*b* are produced together. If natural well pressure is adequate, hydrocarbons will be initially lifted to the surface through the annulus of the lateral wellbore 300. After the initial production period, lift assistance is generally required and a production tubing 316 with a packer 317 and optional downhole pump 316 are run into the main lateral wellbore 300 to provide the required lift assistance until production from the branch lateral wellbores 304*a*, 304*b* becomes uneconomic.

Figure 6:
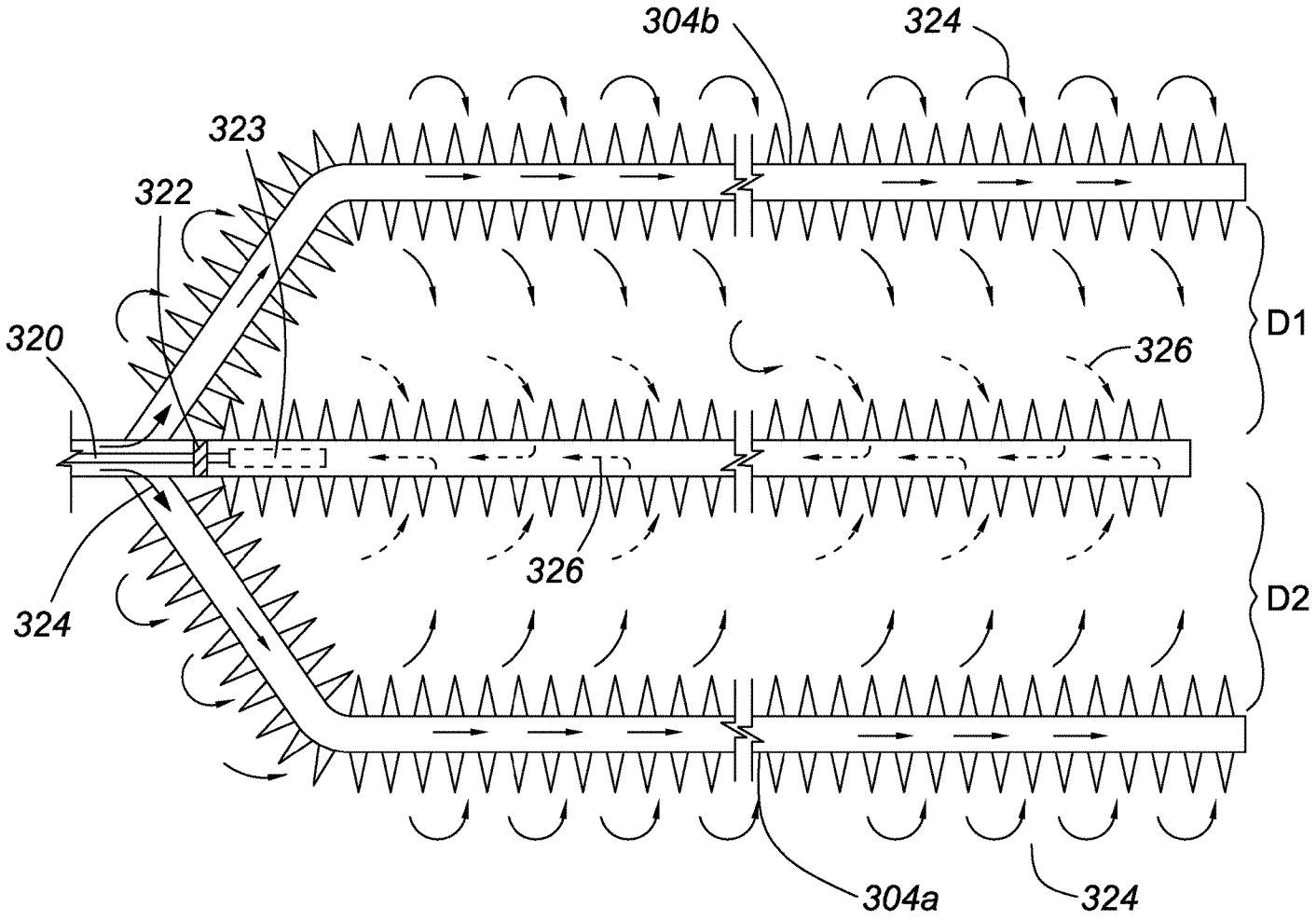
FIG. 6 is a schematic plan view of section 4-4 of the lateral hydrocarbon well shown in FIG. 3 illustrating a method of enhanced oil recovery practiced by injecting EOR flood fluid into the branch lateral bores.

FIG. 6 is a schematic plan view of section 4-4 of the lateral hydrocarbon well 300 shown in FIG. 3 showing branch lateral wellbores 304*a* and 304*b* drilled from the main lateral wellbore 300 and illustrating a method of enhanced oil recovery practiced by injecting EOR flood fluid 324 into the branch lateral bores 304*a*, 304*b*. Before EOR is commenced, the packer 306 (see FIG. 5) is removed and a production tubing 320 and packer 322 are run into the main lateral wellbore 300 and the packer is set near the perforations in the main lateral wellbore 300. An optional downhole pump 323 may be run in at that time as well, or added later if the downhole pressure is inadequate to lift fluids to the surface. The EOR flood fluids 324 are then pumped down the annulus of the lateral hydrocarbon well 300 and into the respective branch lateral bores 304*a*, 304*b*. The EOR flood fluid is forced through the perforations in the respective branch lateral wellbores 304*a*, 304*b* and mobilizes stranded oil 326 in the vicinity of the branch lateral wellbores 304*a*, 304*b* and the main lateral wellbore 300. The recovered oil 326 follows the path of least resistance through the perforations in the main lateral wellbore 300 and is produced to the surface through the production tubing 320, with lift assistance if required. This provides a "clean sweep" of the production cone around the main lateral wellbore 300.

Figure 7:
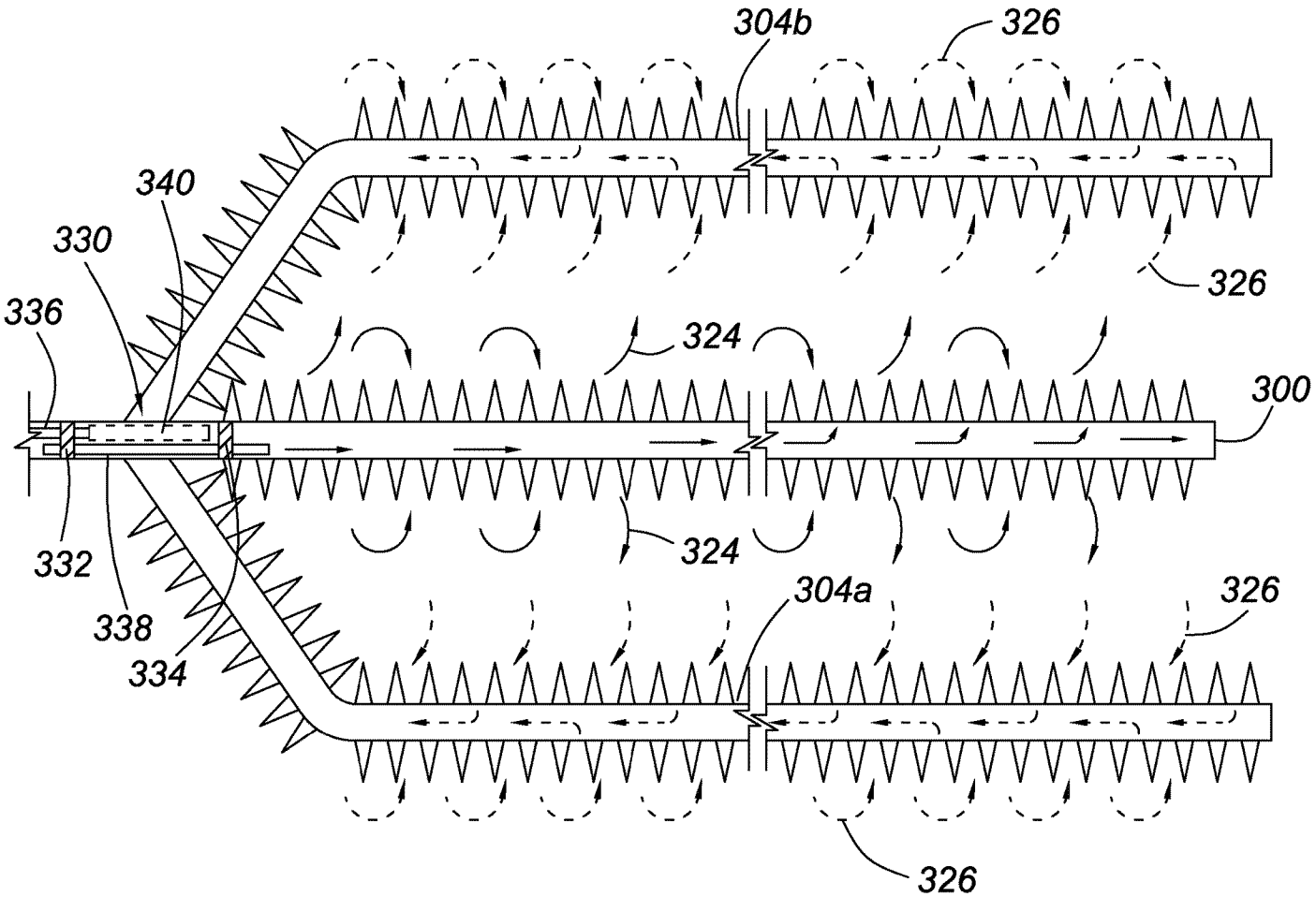
FIG. 7 is a schematic plan view of section 4-4 of the lateral hydrocarbon well shown in FIG. 3 illustrating a method of enhanced oil recovery practiced by injecting EOR flood fluid into the main lateral bore.

FIG. 7 is a schematic plan view of section 4-4 of the lateral hydrocarbon well 300 shown in FIG. 3 showing branch lateral bores 304*a*, 304*b* drilled from the main lateral bore 300 and illustrating a method of enhanced oil recovery practiced by injecting EOR flood fluid into the main lateral bore 300. In accordance with this method, after production from branch lateral wellbores 304*a* and 304*b* has become uneconomic the packer 306 (see FIG. 5) is pulled from the main lateral wellbore 300 and a custom packer unit 330 is run into the main lateral wellbore 300. The custom packer unit 330 includes: a first packer 332; a second packer 334; a production tubing 336 that runs through the first packer 332; a pup joint of tubing 333 that runs through the first packer 332 and the second packer 334; and an optional downhole pump 340 connected to an end of the production tubing 336. All penetrations in the first packer 332 and the second packer 334 are fluid and pressure sealed. Once the custom packer unit 330 is set, EOR flood fluid 324 is pumped down the annulus of the lateral hydrocarbon well 300 and through the pup joint of tubing 338 into the main lateral wellbore of the lateral hydrocarbon well 300. The pressurized EOR flood fluid 324 is forced through the perforations in the main lateral wellbore of the lateral hydrocarbon well 300 and mobilizes stranded oil 326 surrounding the main lateral wellbore. The mobilized stranded oil 326 follows a path of least resistance info the branch lateral wellbores 304*a*, 304*b* and is produced to surface through the production tubing 336, with lift assistance if required.

Figure 8A:
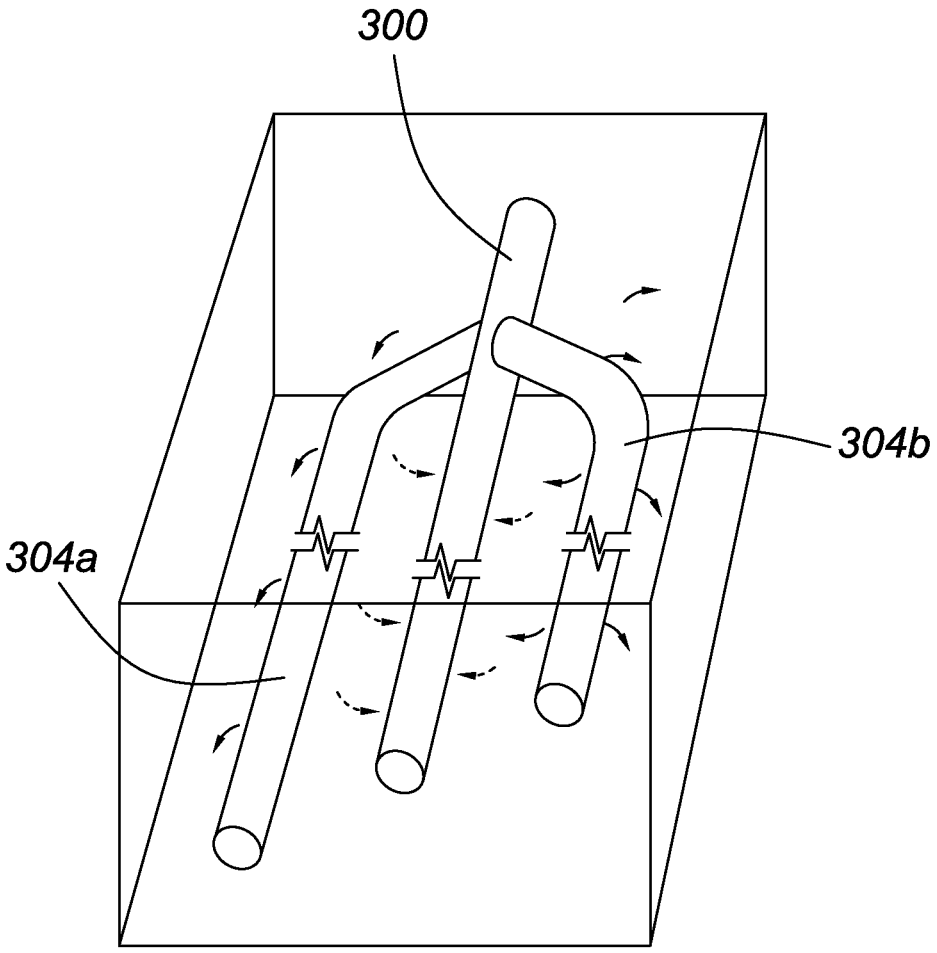
FIG. 8*a* is a schematic three-dimensional diagram of a lateral hydrocarbon well configured for enhanced oil recovery in accordance with the invention.

FIG. 8*a* is a schematic three-dimensional diagram of a lateral hydrocarbon well 300 configured for enhanced oil recovery in accordance with the invention. As can be seen, the branch lateral wellbores 304*a*, 304*b* need not be bored in the same plane as the main lateral here of the lateral hydrocarbon well 300. They are preferably drilled in a plane that is deemed by the well operator to mobilize the most stranded oil after EOR is commenced. The selected plane will depend on the factors described above, namely the porosity characteristics of the production zone, production zone depth and extent, lease restrictions, distance from other bores in the area, etc.

Figure 8B:
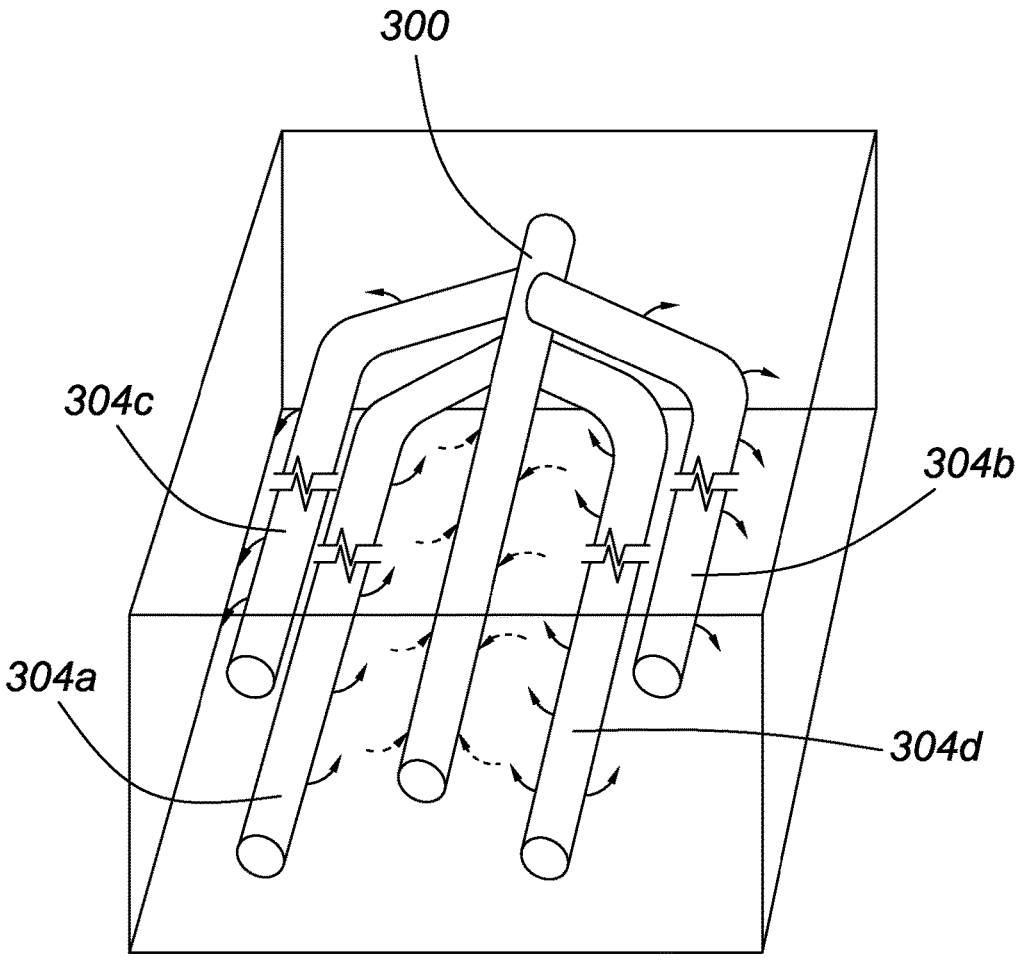
FIG. 8*b* is another schematic three-dimensional diagram of a lateral hydrocarbon well configured for enhanced oil recovery in accordance with the invention.

FIG. 8*b* is another schematic three-dimensional diagram of a lateral hydrocarbon well 300 configured for enhanced oil recovery in accordance with the invention. As can be seen, a well operator is not limited to one or two branch lateral wellbores. If there is adequate depth in the production zone, 3 or more branch lateral wellbores 304*a*-304*d* can be bored, produced and then used tor EOR. This permits a clean sweep of a large area of the production zone without disturbing a large area at the surface, as all operations are performed from the same well pad through the same vertical bore.

Figure 9:
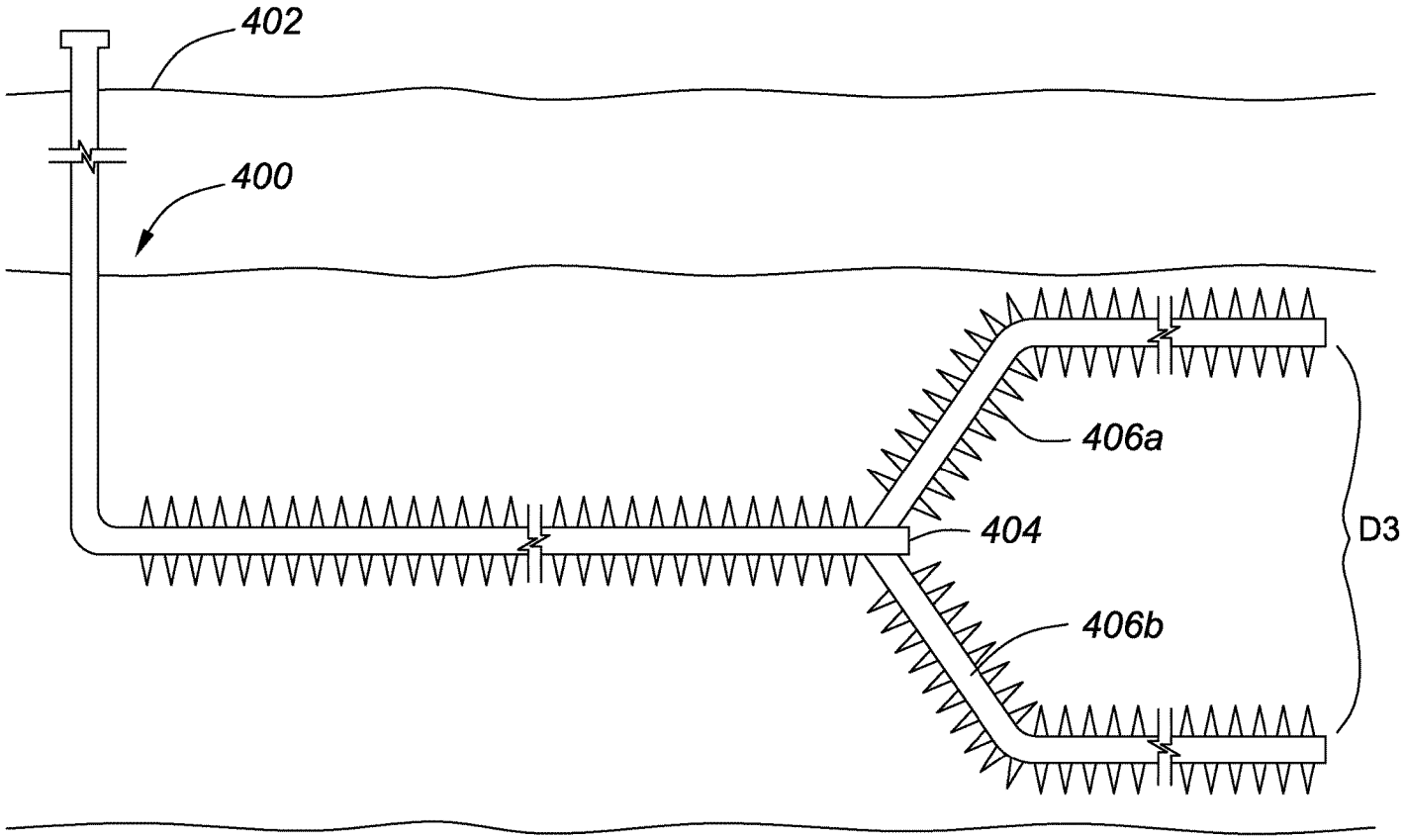
FIG. 9 is a schematic illustration of a method in accordance with the invention of extending the production life and preparing for enhanced oil recovery from an exhausted lateral well.

The invention has been described with specific reference to long lateral wellbores. However, the invention is equally applicable to lateral wellbores that are 4,000', or less, in length. FIG. 9 is a schematic illustration of a method to accordance with the invention of extending the production life and preparing for enhanced oil recovery from an exhausted lateral well 400. In accordance with the invention, the production life of the lateral well 400 is extended and stranded oil is recovered without changing the footprint of a well pad 402 from which the lateral well 400 was drilled. In accordance with the invention, one or more branch lateral wellbores, for example 400*a*, 406*b*, are drilled from an end 404 of the lateral wellbore 400. The planar orientation of the branch lateral wellbores 406*a*, 400*b* with respect to the lateral wellbore 400, and distance D3 between the respective branch lateral wellbores is a matter of well operator choice and dependent on the factors described above in detail with reference to FIGS. 1 and 4. The respective branch lateral wellbores 406*a*, 406*b* are cased, cemented, perforated, stimulated and produced in succession or in unison using methods described above in detail. This has the potential of extending the production life of the wellbore 400 by much more than a factor of 2. Once the branch horizontal wellbores 406*a*, 406*b* have been produced until production becomes uneconomic, enhanced oil recovery is commenced as will be described below with reference to FIGS. 10 and 11.

Figure 10:
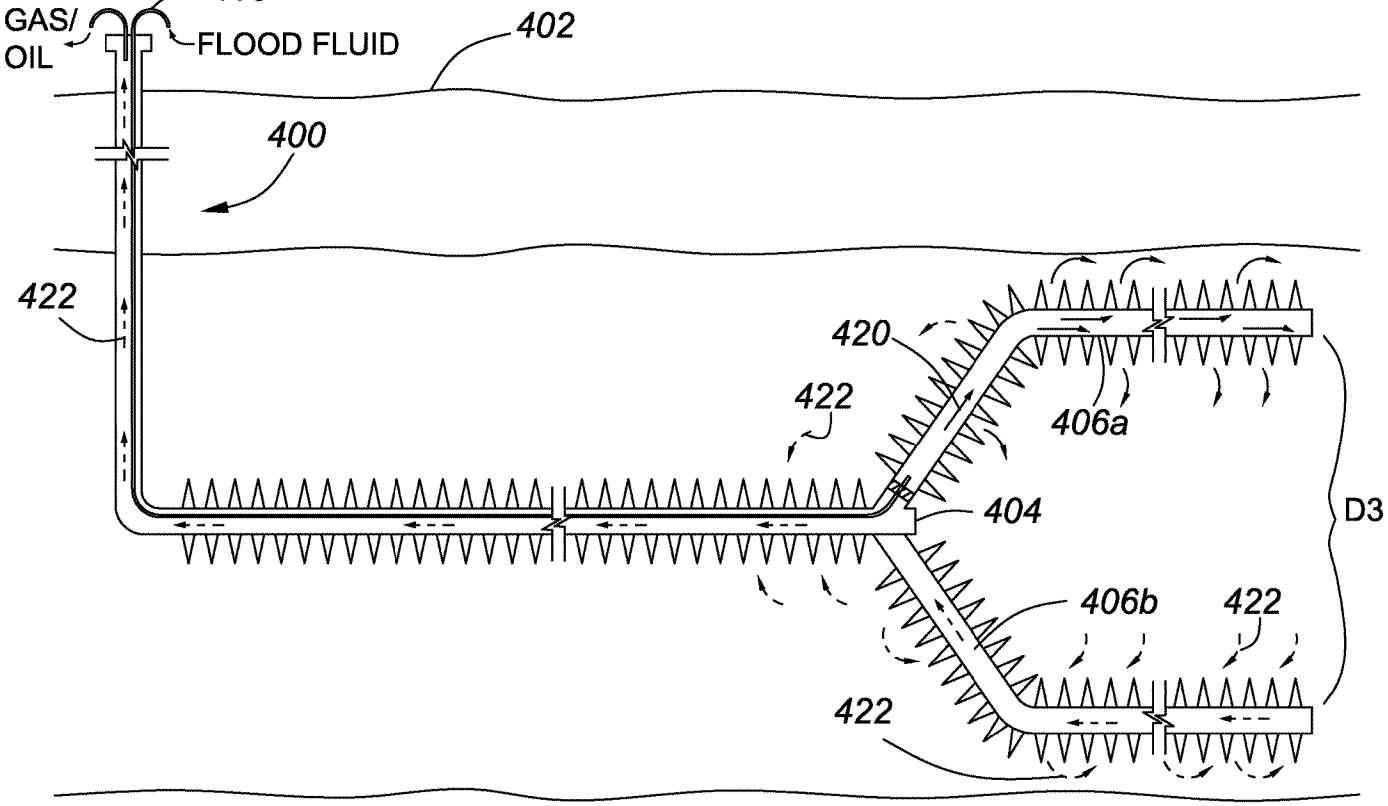
FIG. 10 is a schematic illustration of a method of performing enhanced oil recovery from the lateral well shown in FIG. 9.

FIG. 10 is a schematic illustration of one method of performing enhanced oil recovery from the lateral well 400 shown in FIG. 9. In accordance with this method, tubing 410 and packer 412 are run into the lateral wellbore 400 and the packer is set in and unperforated area in one of the branch lateral wellbores 406*a*, 406*b* (406*a* in this example). EOR flood fluid 420 is then pumped from the surface through the tubing 410 and forced through perforations in the branch lateral wellbore 406*a*. The EOR flood fluid 420 mobilizes stranded oil 422, which follows a path of least resistance through the perforations in the branch lateral wellbore 406*b* and the lateral wellbore 400. When proper additives known in the art are added to the EOR flood fluid 420 and adequate pump pressure is applied, recovered oil 422 comingled with flood fluid 420 will be produced up the annulus of the lateral well 400 to the surface as long the pumping of the EOR flood fluid 420 continues.

Figure 11:
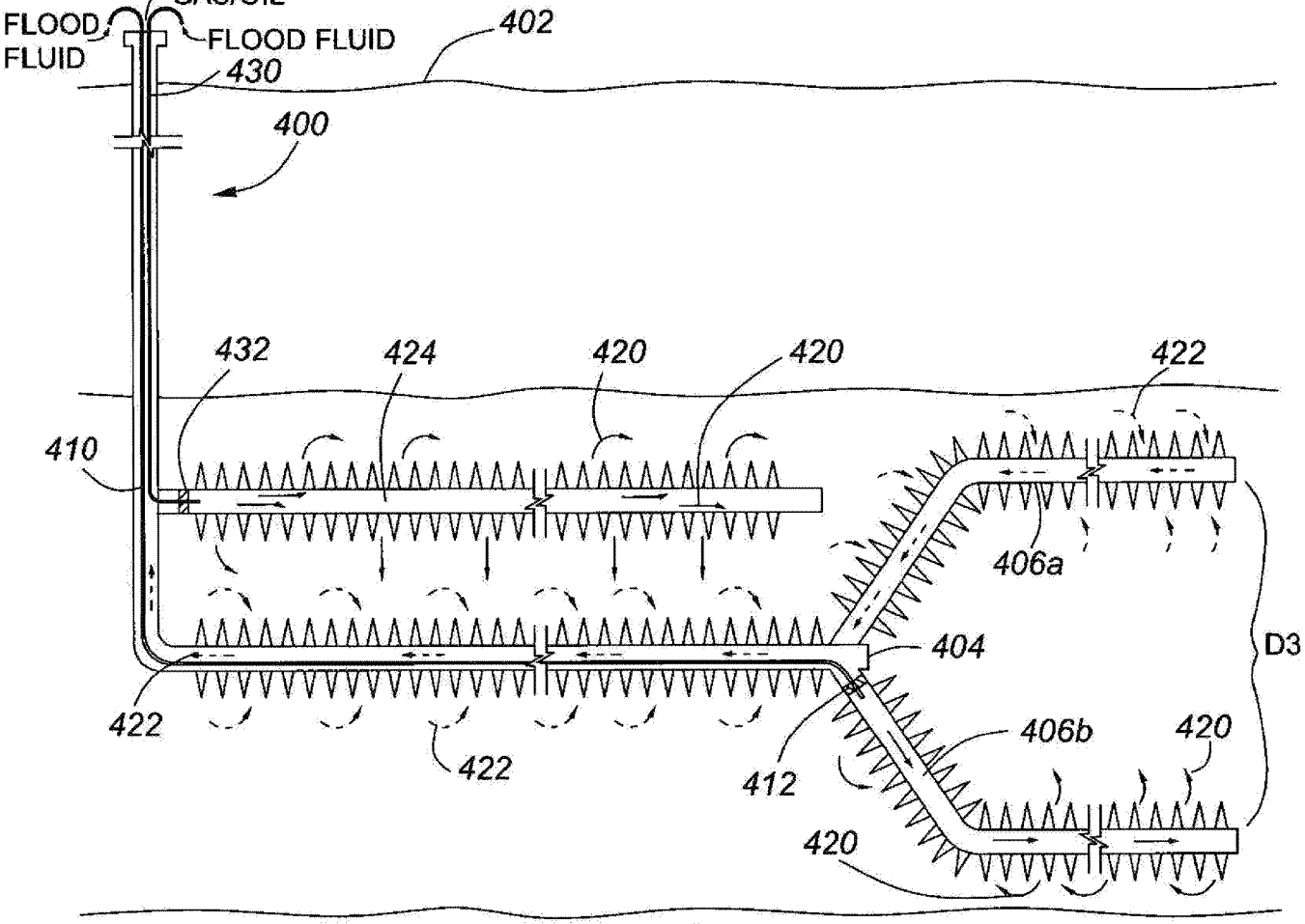
FIG. 11 is a schematic illustration of a further method of performing enhanced oil recovery from the lateral well shown in FIG. 9.

FIG. 11 is a schematic illustration of a further method of performing enhanced oil recovery from the lateral well 400 shown in FIG. 9. In this embodiment, enhanced oil recovery is yet further employed using one or more sidetrack wellbore(s) is drilled above or within the curve of the lateral wellbore 400. The sidetrack wellbore 424, only one of which is illustrated for clarity, is drilled in a predetermined planar orientation with respect to the lateral wellbore 400 and at a distance from the wellbore 400. In accordance with a determination made by the well operator. Once drilled, the sidetrack lateral wellbore 424 is cased, cemented, perforated and produced using methods described above in detail. Alter the sidetrack wellbore 424 has been produced, enhanced oil recovery is commenced. In this method, a tubing 430 is run down the vertical section of the lateral wellbore 400, which generally has a larger diameter than the horizontal section of the lateral wellbore 400, and into the sidetrack lateral 424. A packer 432 provides a fluid tight seal around the tubing 430. As described above with reference to FIG. 10, the tubing 410 and packer 412 may be set in either of branch lateral bores 406*a*, 406*b*. In this example it is set in branch lateral wellbore 406*b*. EOR flood fluid 420 is then pumped down each tubing 410; 430 and recovered oil 422 is produced at the surface, as described above with reference to FIG. 10. This provides the most complete recovery of stranded oil from the vicinity of the lateral wellbore 400, while leaving surface area around the well pad 402 undisturbed.

The explicit embodiments of the invention described above have been presented by way of example only. The scope of the invention is therefore intended to be limited solely by the scope of the appended claims.

I claim:

1. A method of enhanced oil recovery (EOR) from a cased and cemented main lateral wellbore, comprising:

setting a packer in the main lateral wellbore;

drilling at least one sidetrack lateral wellbore spaced from the main lateral wellbore, casing and cementing the, sidetrack lateral wellbore;

perforating and stimulating a first section of the sidetrack lateral wellbore, the first section having a length of less than a total length of the sidetrack lateral wellbore, and producing hydrocarbons from the first section;

removing the packer from the main lateral wellbore;

running production tubing and a packer into the main lateral wellbore and setting the packer in the main lateral wellbore;

injecting EOR flood fluid down an annulus of a vertical section of the main lateral wellbore and into the sidetrack lateral wellbore; and producing hydrocarbons comingled with EOR flood fluid up the production tubing in the main lateral wellbore while injecting the EOR flood fluid;

pulling the packer and production tubing from the main lateral wellbore;

setting a packer to seal off the first section of the sidetrack lateral wellbore; and perforating and stimulating a next section of the sidetrack lateral wellbore and producing hydrocarbons from the next section of the sidetrack lateral wellbore.

2. The method as claimed in claim 1, further comprising:

running the packer and the production tubing back into the main, lateral wellbore and setting the packer; and injecting EOR flood fluid down an annulus of a vertical section of the main lateral wellbore and into the sidetrack lateral wellbore and producing the hydrocarbons comingled with the EOR flood fluids from the production tubing in the main lateral wellbore.

3. The method as claimed in claim 2, further comprising:

repeating the steps of setting a packer, perforating and stimulating, producing hydrocarbons, injecting EOR flood fluid and producing hydrocarbon and EOR flood fluid until an entire length of the sidetrack lateral wellbore has been produced and enhanced oil recovery is complete.

4. The method as claimed in claim 1 wherein drilling the at least one sidetrack lateral wellbore comprises drilling the at least one sidetrack lateral wellbore substantially parallel to the main lateral wellbore and spaced from the main lateral wellbore by a predetermined distance.

5. The method as claimed in claim 4 wherein the predetermined distance is dependent on at least a porosity of a production zone in which the main lateral wellbore is drilled.

6. A method of enhanced oil recovery (EOR) from a cased and cemented main lateral wellbore, comprising:

perforating, stimulating and flowing back a first section of the main lateral wellbore, the first section having a length less than a total length of the main lateral wellbore, and producing hydrocarbons from the first section of the main lateral wellbore;

drilling at least one branch lateral wellbore in an unperforated region of the main lateral wellbore adjacent the perforations of the first section of the main lateral well bore;

casing and cementing the at least one branch lateral wellbore;

perforating, stimulating and flowing back the at least one branch lateral wellbore and producing hydrocarbons from the at least, one branch lateral wellbore;

running production tubing and a packer into the main lateral wellbore and setting the packer to isolate the main lateral wellbore from the at least one branch lateral wellbore; and injecting EOR flood fluid down an annulus of a vertical section of the main lateral wellbore, an unperforated section of the main lateral wellbore and into the at least one branch lateral wellbore, and producing hydrocarbons comingled with EOR flood fluid up the production tubing;

setting a packer in the main lateral wellbore to isolate the main lateral wellbore from the at least one branch lateral wellbore;

perforating, stimulating and flowing back a next section of the main lateral wellbore, the next section haying a length less than a total length of the main lateral wellbore, and producing hydrocarbons from the next section of the main lateral wellbore;

drilling at least one branch lateral wellbore in an unperforated region of the main lateral wellbore adjacent the perforations of the next section of the main lateral well bore, casing and cementing the at least one branch lateral wellbore;

perforating, stimulating and flowing back the at least one branch lateral wellbore and producing hydrocarbons from the at least one branch lateral wellbore;

running production tubing and a packer into the main lateral wellbore and setting the packer to isolate the main lateral wellbore from the at least one branch lateral wellbore; and injecting EOR flood fluid down an annulus of a vertical section of the main lateral wellbore and into the at least one branch lateral wellbore, and producing hydrocarbon comingled with EOR flood fluid up the production tubing in the main lateral wellbore while injecting the EOR flood fluid.

7. The method as claimed in claim 6 wherein setting the packer to isolate the main lateral wellbore from the at least one branch lateral wellbore comprises setting the packer in the main lateral wellbore between the at least one branch lateral wellbore and perforations of the next section of the main lateral wellbore.

8. The method as claimed in claim 6 wherein setting the packer to isolate the main lateral wellbore from the at least one branch lateral wellbore comprises setting a custom packer unit in the main lateral wellbore, the custom packer unit comprising a first packer set in the main lateral wellbore up-hole from the at least one branch lateral wellbore, a second packer set between the at least one branch lateral wellbore and perforations of the next section of the main lateral wellbore, a tubing having open ends that runs through the first and second packers, and the production tubing run through only the first packer.

9. The method as claimed in claim 6 wherein producing hydrocarbon comingled with EOR flood fluid comprises providing lift assistance to lift the hydrocarbons and comingled flood fluid form the main lateral wellbore.

* * * * *